United States Patent [19]

Ciccarello

[11] 4,234,375

[45] Nov. 18, 1980

[54] CUTTER-VACUUM-PLUNGER APPLICATOR

[76] Inventor: Richard Ciccarello, 9 Park Ave., Glen Cove, N.Y. 11542

[21] Appl. No.: 21,934

[22] Filed: Mar. 19, 1979

[51] Int. Cl.[3] ..... B26B 27/00; B26F 1/32

[52] U.S. Cl. ..... 156/530; 30/130; 30/358; 156/475; 156/579

[58] Field of Search ..... 156/518, 520, 530, 261, 156/262, 579, 249, 256, 497, 510, 538, 475, 573; 30/278, 29.5, 358, 125, 130

[56] References Cited

U.S. PATENT DOCUMENTS

| | | | |
|---|---|---|---|
| 2,117,149 | 5/1938 | Clevenger | 30/358 |
| 2,307,281 | 1/1943 | Kraus | 30/358 |
| 2,713,905 | 7/1955 | Hartley | 30/358 |
| 3,515,128 | 6/1970 | McEvoy | 30/358 |
| 3,668,047 | 6/1972 | Heller | 156/249 |
| 4,162,183 | 7/1979 | Estes | 156/497 |

*Primary Examiner*—Michael G. Wityshyn
*Attorney, Agent, or Firm*—Frank Makara

[57] ABSTRACT

This invention relates to a vacuum created by a plunger to suck up a disc cut by the razor-edged nozzle of said applicator, and thereafter mechanical-plunger pushing said cut disc into a golf ball cavity. The material cut into disc shape to be disposed in said golf ball cavities being a planar diffraction grating.

In order to aid in the game of playing golf, a diffraction grating is disposed in one or more pre-selected cavities of a golf ball. The diffraction grating aids the golf player to steady his aim on the ball during the swing of the golf club.

1 Claim, 4 Drawing Figures

CUTTER-VACUUM-PLUNGER APPLICATOR

This invention relates to a mechanism used to cut the grating to a disc size to fit a conventional golf ball cavity and thereafter suck up cut disc into a borehole of a plunger element by an outward movement of a special plunger followed by application of said cut disc in said borehole being mechanically pushed by said plunger into the said golf ball cavity in press fit adhesive relationship.

It is an object of this invention to provide a specific type of mechanism to cut a disc from a film and thereafter apply said cut disc into a golf ball cavity surface-to-surface engaging relationship. This and other objectives of this invention will become apparent upon reading the following descriptive disclosure taken in conjunction with the accompanying drawing of an illustrative embodiment in which.

Figure 3:
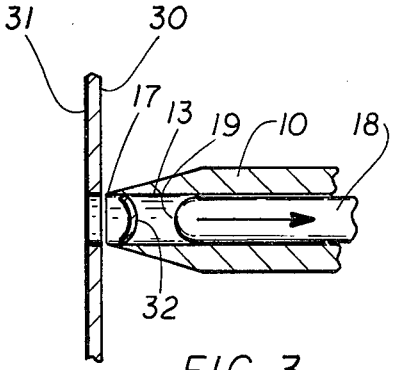
Figure 4:
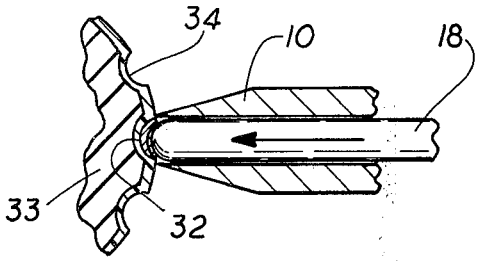

FIG. 3 is a detail section view of the front end of the applicator, broken away in part, showing the manner of cutting a disc from a film strip and thereafter vacuum sucking the cut disc into the borehole of the barrel element by outward movement of the plunger element and FIG. 4 is a detail view similar to FIG. 3, but showing the mechanical pushing of the round end of the plunger against the disc and into the golf ball cavity.

Figure 1:
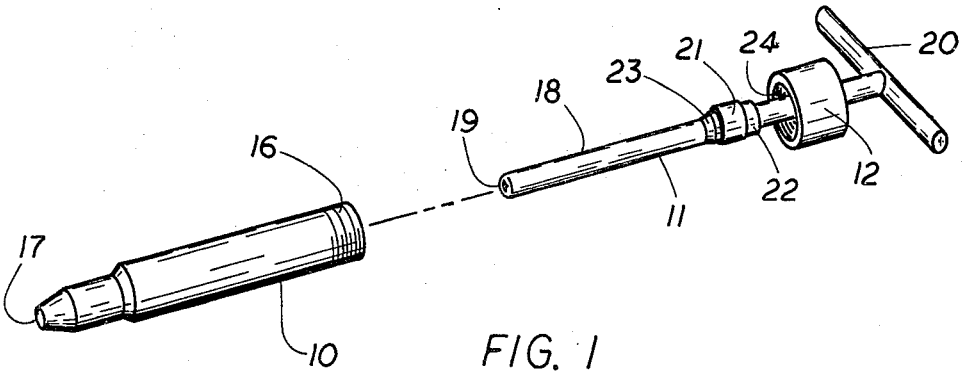
FIG. 1 is an exploded view of the applicator showing the barrel element having a razor sharp cutting nozzle; the plunger element having a handle; and a screw-threaded element for securing said plunger element within said barrel element.

Turning to the drawing, and FIG. 1 in particular, the applicator comprises a barrel element 10, a plunger element 11 and a screwthreaded slidable cap element 12 for securing the barrel element 10 to the movable plunger element 11.

The barrel element 10 is provided with a step-back dual borehole having a forward bore of small diameter 13 and a bore of larger diameter 14 with a sloped, angular valve set 15 therebetween. The barrel 10 is of predetermined length and made preferably of metal. The length of the small bore 13, the large bore 14, and the location of the slope wall 15 are pre-determined and critical. The barrel is further provided at its exterior large orifice with screwthreads 16. The barrel 10 is further provided with a razor sharp circular cutting edge 17 of pre-determined diameter.

Figure 2:
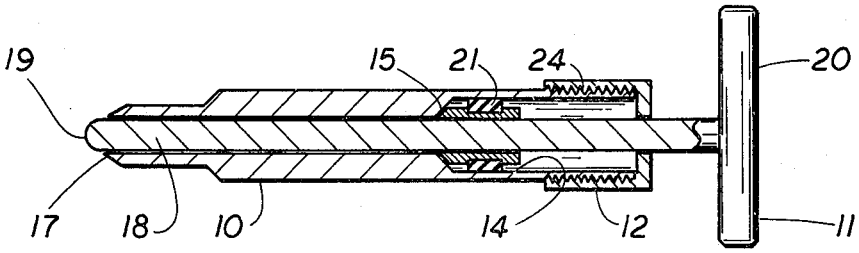
FIG. 2 is a cross-section view of the assembled device of FIG. 1 showing the manner and relationship of the plunger parts within the barrel element and the manner of securing the plunger and the barrel elements together.

The plunger element of this invention is of novel construction and of critical proportions and configurations. As shown in FIG. 2, the plunger element 11 is completely advanced into the barrel element 10.

The plunger element 11 comprises a shaft 18 having a round or hemispherical nose 19 and is secured integrally to a handle 20. A very important feature of this invention is the provision of rubber circular means 21 for forming a vacuum, said means 21 being disposed around said plunger shaft 18 at a critical length thereof to engage said large bore 14 of said barrel 11 in gas-tight or hermetically sealed relationship. The flexible element

21, preferably of rubber but suitable plastic is operable, is held captively to said shaft 18 by an integral collar having a pair of annular suitably spaced-apart holding walls 22. The inner edge collar annular wall 22 is provided with a slope wall 23 to suitably engage the coacting wall 15 of the barrel when the plunger 11 is disposed in its innermost position for inserting a cut disc into a golf ball (FIG. 2). Thus, the plunger rubber suction forming element 21 travels to and fro with the movement of the plunger itself.

The screw cap 12 is provided with screwthreads 24 to engage threads 16 of said barrel element 10 and is slidingly disposed on shaft 18.

In the manufacture of the plunger element 18, the collar element and its annular walls 22 for retaining the rubber ring 21 may be made from a single piece of rod stock, suitably cut.

FIG. 3 shows the manner of cutting film strip refracting grating planar material 30 with the leading cutting edge 17 of the barrel element 11. The film strip is provided with a pressure sensitive adhesive layer 31. As shown in FIG. 3, after the barrel element 11 is pressed to cut the disc and the disc is disposed within the small borehole 13, the plunger shaft 18 is pulled outwardly to create a vacuum by rubber plunger 21 to dispose the cut disc 32 in a curved concave relationship to the orifice cutting edge of borehole 13, thereby protecting the adhesive surface configurating the disc to facilitate its insertion in a golf ball 33 cavity 34.

As shown in FIG. 4, the inward movement of the plunger shaft 18 mechanically forces the cut disc 32 into a golf ball cavity 30 with suitable pressure against the pressure sensitive adhesive to effect a permanent bond to the golf ball 33.

I claim:

1. A triple action cutting, suction and plunger applicator to cut a disc of planar material and thereafter apply the cut disc to a concave cavity of a golf ball surface, comprising a barrel element having a dual diameter borehole centrally disposed therein and having a suitably sloped annular wall critically disposed therebetween, the small diameter of said borehole barrel being provided with a bottom circular cutting edge and the exterior of the barrel at the larger diameter borehole end being provided with screw threads; an integral plunger shaft element adapted to slidingly fit into the small diameter of said barrel and provided with a critically round end adapted to snugly fit a golf ball cavity, said shaft element having an integral collar critically located thereon and adapted to be disposed in the larger borehole, said collar having a pair of annular spaced-apart walls adapted to receive a flexible rubber ring, said collar having also a sloped wall adapted to mate with said sloped wall of said barrel upon innermost movement of said plunger element, said plunger element being further provided with handle means for effecting the movement thereof; a rubber pneumatic ring disposed slidingly and captively within said collar between the annular walls thereof; and an apertured interiorly screw threaded cap disposed slidingly upon said plunger shaft element adjacent said handle means to lockingly retain said shaft element to said barrel element.

* * * * *